US005480486A

United States Patent [19]

Burns

[11] Patent Number: 5,480,486

[45] Date of Patent: Jan. 2, 1996

[54] CONTINUOUS ADJUSTABLE BACKING BAR FOR PROFILING COATER BLADE

[75] Inventor: James R. Burns, Springfield, Pa.

[73] Assignee: Beloit Technologies, Inc., Wilmington, Del.

[21] Appl. No.: 171,306

[22] Filed: Dec. 21, 1993

[51] Int. Cl.[6] ..... B05C 11/04

[52] U.S. Cl. ..... 118/123; 118/126

[58] Field of Search ..... 118/123, 126; 15/256.5, 256.51; 162/281; 100/174; 101/162

[56] References Cited

U.S. PATENT DOCUMENTS

| | | | |
|---|---|---|---|
| 3,683,851 | 8/1972 | Nolden | 118/126 |
| 3,785,340 | 1/1974 | Stafford et al. | 118/110 |
| 4,349,934 | 9/1982 | Margittai | 15/256.51 |
| 4,679,524 | 7/1987 | Eklund | 118/122 |
| 4,688,516 | 8/1987 | Sommer | 118/410 |
| 4,860,686 | 8/1989 | Kato et al. | 118/410 |
| 4,869,933 | 9/1989 | Sollinger et al. | 427/536 |
| 4,873,939 | 10/1989 | Eskelinen | 118/410 |
| 4,899,687 | 2/1990 | Sommer et al. | 118/126 |
| 5,074,243 | 12/1991 | Knop et al. | 118/665 |
| 5,077,095 | 12/1991 | Alheid | 427/356 |
| 5,081,951 | 1/1992 | Most et al. | 118/126 |
| 5,156,682 | 10/1992 | Zimmer | 118/119 |

FOREIGN PATENT DOCUMENTS

| | | |
|---|---|---|
| 4203398 | 8/1992 | Germany . |
| 2252926 | 8/1992 | United Kingdom . |

*Primary Examiner*—James C. Housel
*Assistant Examiner*—Long V. Le
*Attorney, Agent, or Firm*—Dirk J. Veneman; Raymond W. Campbell; David J. Archer

[57] ABSTRACT

A backing bar assembly has a plurality of positively positionable backing bar units which are retained within an inverted U-shaped housing by semi-cylindrical lifters which are adjusted by adjustment screws connected to the housing. Each backing bar unit has concave end surfaces which face the adjacent backing bar units. A pair of backing bar units is engaged by the semi-cylindrical convex surfaces of a lifter and may thus be vertically positioned by rotation of the adjustment screw. By adjusting two backing bar units at a single screw, dramatic discontinuities between backing bar units are avoided. An inflatable resilient seal is engaged by all the backing bar units and extends between the units and the blade to transmit force to the blade to retain it in a desired position.

9 Claims, 2 Drawing Sheets

CONTINUOUS ADJUSTABLE BACKING BAR FOR PROFILING COATER BLADE

FIELD OF THE INVENTION

The present invention relates papermaking equipment in general, and to backing bars for profiling coater blades in papermaking in particular.

BACKGROUND OF THE INVENTION

Coatings are applied to paper webs when it is desired to achieve certain specialized properties in the finished stock. Blade coaters apply the liquid coating material to the moving paper web by bearing a blade which runs the width of the web at an angle against the web and discharging the coating material onto the paper in advance of the blade.

It is important to obtain an even layer of the coating material on the paper web, or else the final stock may display blemishes or streaks when printed upon. As the coater blade may extend from 200 to 300 inches across the web width, apparatus have been developed which allow the adjustable application of pressure against the blade through a multiplicity of backing bar units held in a housing and urged against the coater blade. These backing bar units have been each threadedly mounted to the housing and individually adjusted to incrementally position the coater blade. However, the individually adjustable backing bar units present discontinuities, or instantaneous changes in elevation between adjacent units. These discontinuities can result in streaking or other unevenness in the applied coating, particularly at high web speeds.

What is needed is a backing bar assembly for a coater blade which may be continuously adjustably along its length to apply pressure against the blade without sudden changes.

SUMMARY OF THE INVENTION

The backing bar assembly of the present invention employs a plurality of positively positionable backing bar units which are retained within an inverted U-shaped housing by semi-cylindrical lifters which are adjusted by adjustment screws connected to the housing. Each backing bar unit has concave end surfaces which face the adjacent backing bar units. A pair of backing bar units is engaged by the semi-cylindrical convex surfaces of a lifter and may thus be vertically positioned by rotation of the adjustment screw. By adjusting two backing bar units at a single screw, dramatic discontinuities between backing bar units are avoided. An inflatable resilient seal is engaged by all the backing bar units and extends between the units and the blade to transmit force to the blade to retain it in a desired position.

It is an object of the present invention to provide a backing bar assembly for a profiling blade which provides continuous and adjustable loads to the blade.

It is another object of the present invention to provide a backing bar assembly for a profiling blade which adjusts multiple backing bar units at a single location.

It is also an object of the present invention to provide a backing bar assembly for a profiling blade which is less susceptible to wear.

Further objects, features and advantages of the invention will be apparent from the following detailed description when taken in conjunction with the accompanying drawings.

DESCRIPTION OF THE PREFERRED EMBODIMENT

Figure 1:
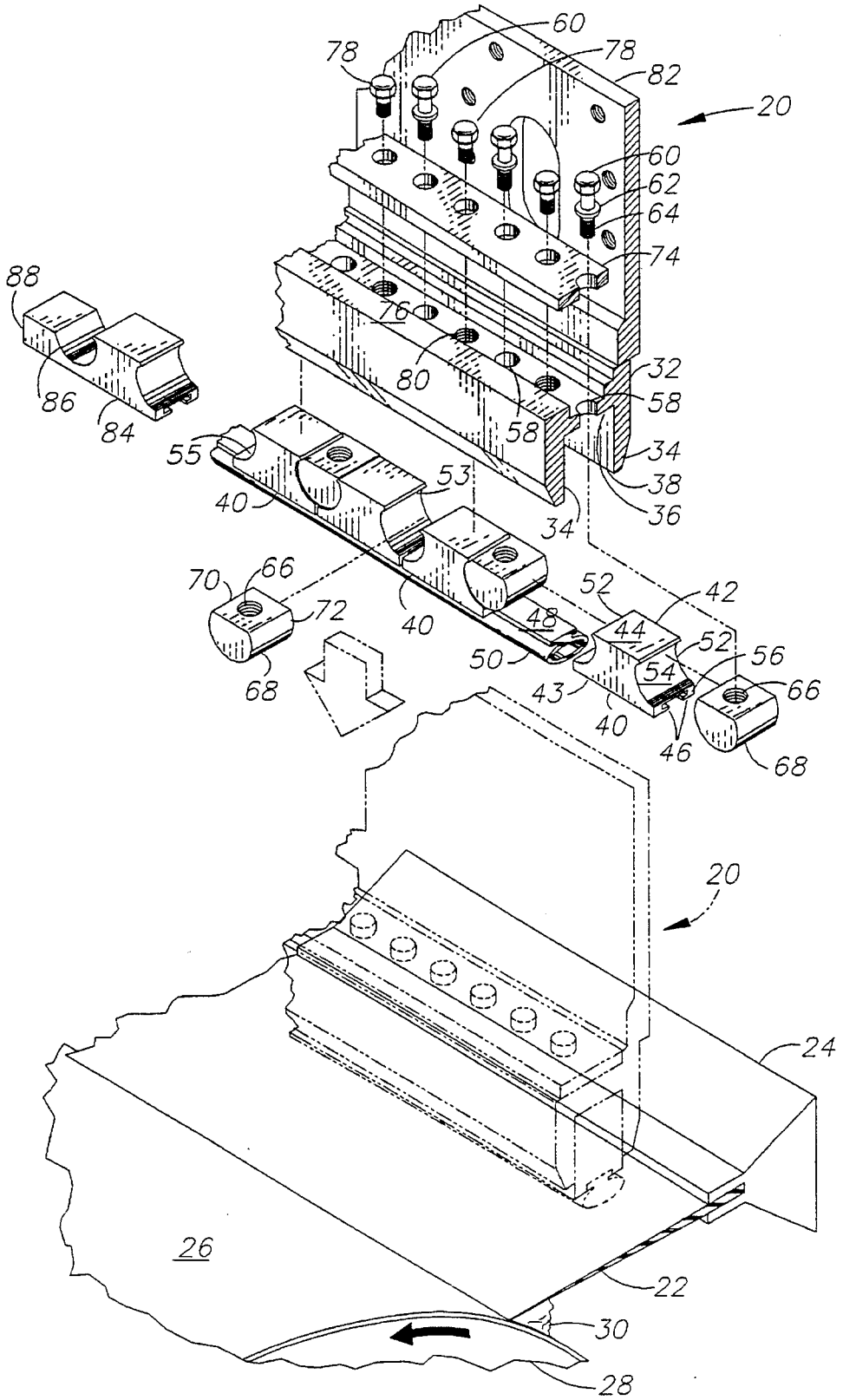
FIG. 1 is a fragmentary, exploded isometric view of the backing bar assembly of this invention, shown in relation to a profiling coater blade in phantom view.
Figure 2:
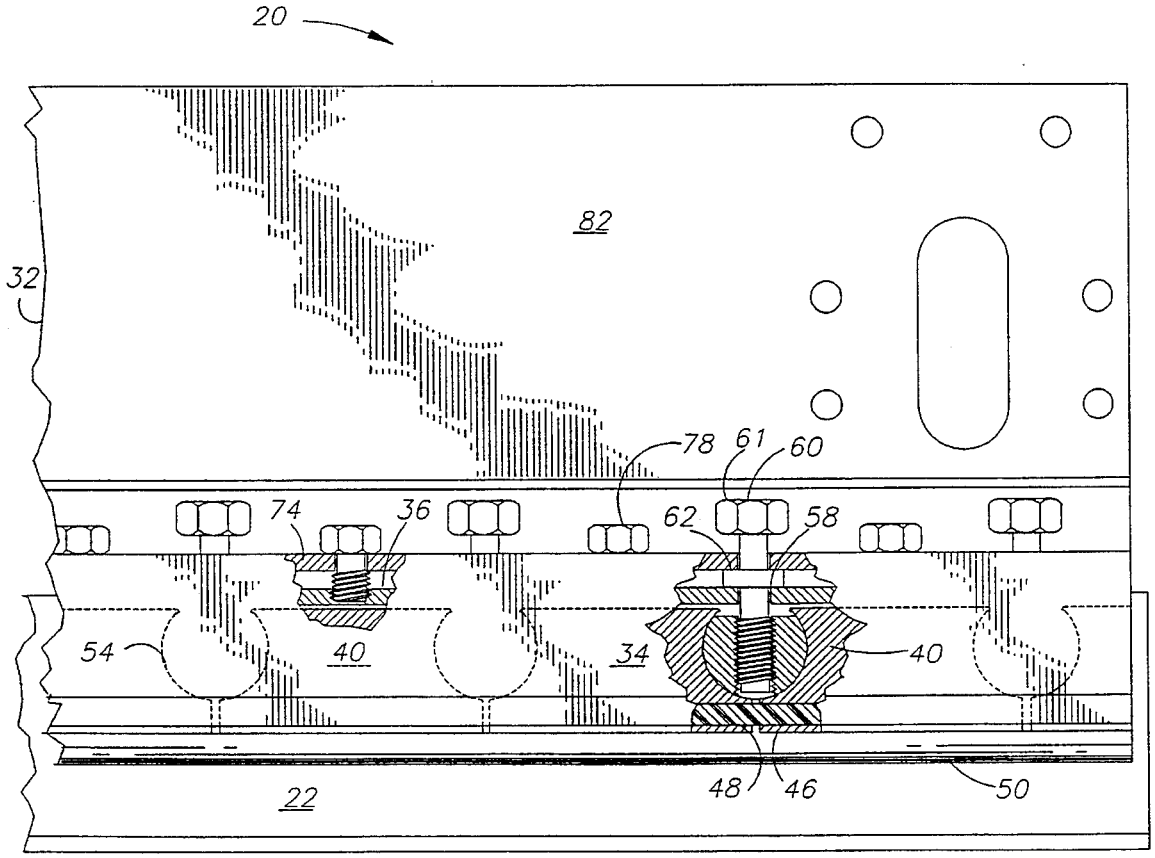
FIG. 2 is a front elevational view of the backing bar assembly of FIG. 1, partly broken away in section.

Referring more particularly to FIGS. 1–2, wherein like numbers refer to similar parts, a backing bar assembly 20 is shown in FIG. 1 in relation to a profiling coater blade 22. The coater blade 22 is held in a support structure 24 which is shown in simplified form. The coater reservoir, supply tubes and related structure have been omitted for clarity. The coater blade 22 is engaged against a paper web 26 which is carried on a backing roll 28 to meter the thickness of a coating material 30 applied to the paper web. In the figures a fragment only of the web 26 and backing roll 28 is shown. It should be understood that the machine width of the apparatus may be one-hundred to four-hundred inches or more.

The backing bar assembly 20 has a machined metal housing 32 with two downwardly extending walls 34 which are joined by a floor 36 to define an inverted U-shaped channel 38 which opens downwardly toward the blade 22. The channel 38 is rectilinear and receives therein a plurality of backing bar units 40.

Each backing bar unit 40 is a solid block with vertical front and rear faces 42, 43 which are spaced apart sufficiently to allow the free fitting of the units between the walls 34 of the channel 38. Each bar unit 40 has a top surface 44 which is spaced beneath the channel floor 36 and two opposed lower lips 46 which engage and retain the flange 48 of an inflatable resilient member ,50. Each of the two ends 52 of the backing bar units have portions which define semi-cylindrical concave side surfaces 54 which extend between the front and rear faces 42, 43. The backing bar units thus have upper projections 53 and lower projections 55 which together define the side surfaces 54. A vertical end surface 56 extends beneath each concave side surface 54. In an exemplary embodiment, each backing bar unit 40 is approximately three inches wide between end surfaces 56.

Holes 58 are formed in the housing floor 36 through which adjustment screws 60 extend. Each adjustment screw 60 has a head 61 and a flange 62 beneath the head which engages with the housing floor 36. A threaded shank 64 extends downwardly from the flange 62 and is threadedly engaged with a threaded aperture 66 formed within a lifter 68.

Each lifter 68 has a horizontal top surface 70 which is spaced beneath the floor 36, and a semi-cylindrical convex lower surface 72. The semi-cylindrical lower surface 72 is defined about an axis which extends perpendicular to the adjustment screw and which is oriented in the paper web direction of travel. The holes 58 are positioned in the housing floor 36 to locate a lifter 68 between two adjacent backing bar units 40. The lifters 68 are dimensioned such that the lifter lower surface 72 closely engages in supporting relation the concave side surfaces 54 of two adjacent backing bar units 40. The adjacent backing bar units 40 in a pair are closely spaced from one another when horizontal, on the order of approximately five hundredths of an inch apart.

A horizontal retention plate 74 is bolted to the housing and supported on upwardly protruding portions of the housing which define a ledge 76. The ledge 76 extends on each side of the floor 36 and spaces the retention plate 74 above the floor 36 to provide a space for the adjustment screw flanges 62 to rotate unobstructed. As shown in FIG. 2, the retention plate 74 is held in place by a plurality of fasteners 78 which are engaged with threaded holes 80 in the housing floor 36 located between the adjustment screw holes 58.

The housing 32 has an upwardly extending bracket 82 which may be pivotably mounted to the papermaking machine frame for holding the backing bar assembly in place during operation of the papermaking equipment and allowing the backing bar assembly 20 to be displaced for maintenance and repair of the equipment.

As shown in phantom view in FIG. 1, in operation the backing bar assembly 20 is urged against the profiling blade 22. Each adjustment screw 60 may be rotated to position the lifters 68 at the desired level to obtain a consistent application of coating material 30 to the web 26. As the adjustment screw is rotated the lifter will move up or down the threaded shank 64 of the adjustment screw 60, depending on direction of rotation. The vertical displacement of the lifter 68 will simultaneously elevate or depress the two backing bar units 40 of an adjacent pair by engaging against the upper projection 53 to lift up, or the lower projection 55, to depress. However, because of the pivotable engagement between the lifter 68 and the backing bar units 40, the backing bar units will not be simply translated vertically by rotation of the adjustment screws 60, but will be tilted toward or away from the adjustment screw depending on the elevation of the next adjustment screw 60. Thus a discontinuous break or jump will not be formed between adjacent backing bar units 40. Instead the profile of the assembly of backing bar units 40 will be a continuous series of planes each at an angle to one another, but never forming a discrete step from one to the next. The result of this continuous disposition of the backing bar units 40 is a more consistent and controlled pressure applied to the resilient member 50, and hence to the blade 22.

The resilient member 50 is supplied with a fluid under pressure to adjust the level of force applied overall to the coater blade 22.

As shown in FIG. 1, the terminal backing bar units 84, which are not located between two other units 40, but are the last unit in the assembly, have an upwardly opening semi-cylindrical cavity 86 formed therein which is engaged with a lifter 68. The terminal unit 84 has an end piece 88 which is approximately half the height of a backing bar unit 40 to allow tilting of the end of the terminal unit 84 without interference with the housing floor 36.

It should be noted that in addition to providing a more continuous profile, the assembly 20 will be expected to subject the individual backing bar units to reduced wear, as they will not be disproportionately engaged against the blade on only one side or the other as may be the case with a center-adjusting backing bar unit. The pivotable nature of the backing bar units allows them to more nearly conform to the profile of the web and backing roll to reduce disproportionate wear.

It should be noted that lifters employing different geometry for positively displacing the backing bar units may also be employed. Furthermore, multiple backing bar assemblies may be utilized with a single blade if circumstances warrant.

It is understood that the invention is not limited to the particular embodiments disclosed and illustrated herein, but embraces such modified forms thereof as come within the scope of the following claims.

I claim:

1. A backing bar assembly engaging against a coater blade in a papermaking machine, the assembly comprising:

a bar housing disposed above the coater blade;

a plurality of bar units positioned within the housing for vertical displacement therein, wherein two adjacent bar units define an adjacent pair of bar units;

a lifter member positioned between each adjacent pair of bar units and engaged with the bar units of the pair; and an adjustment screw extending between the bar housing and threadably engaging said lifter member, such that rotation of the adjustment screw causes a vertical displacement of the lifter member and the two bar units engaged thereto, and wherein the bar units apply a force to the coater blade to achieve a desired uniformity of blade disposition.

2. The apparatus of claim 1 wherein each bar unit of a pair has a concave surface which faces the adjacent bar unit, and wherein each lifter member has a convex surface which engages with the concave surfaces of the bar units, such that upward and downward displacement of the lifter member will cause the engaged backing bar units to tilt relative to said adjustment screw.

3. The apparatus of claim 1 further comprising an inflatable resilient member engaged beneath all of the bar units and extending between the bar units and a profiling blade, wherein the force of the bar units is applied to the profiling blade through the resilient member.

4. The apparatus of claim 1 wherein the adjustment screw comprises a threaded shank which extends beneath a fixed flange which is positioned beneath an adjustable head, and further comprising:

portions of the housing which define a downwardly opening channel which receives the bar units therein;

portions of the housing defining a floor which extends above the channel; and portions of the housing floor which define a plurality of adjustment screw holes which extend through the floor, wherein each adjustment screw shank extends through an adjustment screw hole and is threadedly engaged with a lifter unit, and wherein the adjustment screw flange engages against the housing floor.

5. The apparatus of claim 4 further comprising: portions of the housing which extend upwardly from the floor to define a ledge;

a retention plate which is engaged with the ledge and spaced above the floor; and a plurality of fasteners which extend through the retention plate and which are threadedly engaged with the housing floor, and wherein the adjustment screws extend through the retention plate such that the adjustment screw flanges are retained between the housing floor and the retention plate.

6. A backing bar assembly for engaging against a blade in a papermaking machine, the assembly comprising:

a bar housing disposed above the blade;

at least one pair of bar units positioned within the housing for vertical displacement and tilting relative to said housing;

a lifter member positioned between and engaged with each of the bar units in a pair, wherein the lifter member remains engaged with both bar units as the lifter member is elevated or depressed, and further wherein the lifter member engages with the bar units to cause a tilting of the bar units relative to said housing upon vertical adjustment of the lifter member;

threaded means threadably cooperating with each lifter for adjusting the vertical position of each lifter member connected to the housing, wherein the bar units apply a force to a coater blade to achieve a desired uniformity of blade disposition.

7. The apparatus of claim 6 wherein each bar unit of a pair has a concave surface which faces an adjacent bar unit, and wherein each lifter member has a convex surface which engages with the concave surfaces of the bar units, such that upward and downward displacement of the lifter member will elevate or depress, respectively, the backing bar unit surfaces.

8. The apparatus of claim 6 wherein each backing bar unit has a concave semi-cylindrical surface which faces the concave semi-cylindrical surface of an adjacent backing bar unit, and wherein each lifter has a convex semi-cylindrical lower surface which engages the concave surfaces of the pair of backing bar units, and vertical displacement of the lifters causes the backing bar units to be pivoted and vertically displaced.

9. The apparatus of claim 6 further comprising:

a terminal backing bar unit having portions defining an upwardly opening semi-cylindrical cavity; and a lifter member engaged with the upwardly opening cavity of the terminal backing bar unit only for pivoting of the terminal backing bar unit.

* * * * *